US006930649B1

(12) United States Patent
Sergi

(10) Patent No.: US 6,930,649 B1
(45) Date of Patent: Aug. 16, 2005

(54) LOG-PERIODIC DIPOLE ANTENNA

(76) Inventor: Paul D. Sergi, 2570 Major Rd., Peninsula, OH (US) 44264

( * ) Notice: Subject to any disclaimer, the term of this patent is extended or adjusted under 35 U.S.C. 154(b) by 10 days.

(21) Appl. No.: 10/356,802

(22) Filed: Feb. 3, 2003

(51) Int. Cl.[7] ..... H01Q 11/10
(52) U.S. Cl. ..... 343/792.5; 343/793; 343/874
(58) Field of Search ..... 343/792.5, 793, 343/874, 878, 884, 892, 904–905, 907

(56) References Cited

U.S. PATENT DOCUMENTS 3,576,580 A * 4/1971 Enyedy ..... 343/792.5
3,618,103 A * 11/1971 Ringland ..... 343/727
3,653,056 A * 3/1972 Peterson ..... 343/795
3,984,841 A * 10/1976 Mikulich et al. ..... 343/792.5
4,010,473 A * 3/1977 DiMeo et al. ..... 343/792.5

* cited by examiner

*Primary Examiner*—Thuy V. Tran
(74) *Attorney, Agent, or Firm*—Renner, Kenner, Greive, Bobak, Taylor & Weber

(57) ABSTRACT

A log-periodic dipole antenna (10) includes a boom (12) which through insulator blocks (15) carries a plurality of elements (13) consisting of element halves (13A, 13B) which extend in opposite directions from the boom (12). Spaced transmission wires (38A, 38B) extend along the boom (12) without crossing each other and yet communicate with alternatingly opposite element halves (13A, 13B) of adjacent elements (13) in view of their connection with brackets (30A, 30B) attached to element halves (13A, 13B). The transmission wires (38A, 38B) are spaced at the point of communication with each element (13) a distance proportional to the impedance of that particular element (13) by virtue of their being attached at different locations along the brackets (30A, 30B).

25 Claims, 5 Drawing Sheets

LOG-PERIODIC DIPOLE ANTENNA

TECHNICAL FIELD

This invention relates to the construction and design of antennas. More particularly, this invention relates to the construction and design of log-periodic dipole antennas.

BACKGROUND ART

Antennas of the log-periodic dipole type are designed to assist in the transmission or reception of radio wave signals. These antennas include a plurality of spaced elements which are carried by and extend outwardly from an insulator which is attached to a boom. Feeder or transmission wires are connected to the elements to carry the signals to be transmitted or the signals received by the elements.

Several problems exist regarding the current design and configuration of such antennas. For example, one problem related to these antennas is that in the current designs the transmission wires must cross each other so that their attachment to adjacent elements can be made on alternating sides of the boom. However, the crossover of the transmission or feeder wires has an effect on the impedance created by the wires. The impedance of the transmission line is dependent on the diameter of the two wires and the distance between them. As you allow the wires to cross each other, the distance between them varies and thus the impedance varies. But the impedance of the transmission wires should remain constant and match the impedance of the elements so that a maximum transfer of the signal exists from the elements to the transmission lines or from the transmission lines to the elements.

Regarding impedance matching, the impedance of a element is a function of its length-to-diameter ratio. If you know the impedance of the transmission wires, based on their diameter and spacing, as discussed above, the elements must be designed to match such impedance. However, in the typical array of elements, their lengths vary from element to element and thus, if the impedance of the feeder wires is constant, the diameter of the elements must be varied. This can add to the cost and weight of the antenna and requires the design and use of insulators capable of receiving elements of substantially varying sizes.

As a result, the need exists for a simple system for matching the impedance of the transmission wires to the elements, while at the same time avoiding the need to cross the transmission wires.

DISCLOSURE OF THE INVENTION

It is thus an object of the present invention to provide an antenna which has transmission wires which do not cross and yet which are connected to adjacent elements which extend from opposite sides of the boom.

It is another object of the present invention to provide an antenna, as above, in which the impedance of the transmission wires can be matched to the varying impedances of the elements by varying the spacing between the transmission wires.

It is an additional object of the present invention to provide an antenna, as above, in which the impedance of the transmission wires can be matched to the varying impedances of the elements by varying the diameter of the transmission wires.

It is a further object of the present invention to provide an antenna, as above, which can utilize elements of a constant diameter, and insulators which attach the elements to the boom of a single size and design.

These and other objects of the present invention, as well as the advantages thereof over existing prior art forms, which will become apparent from the description to follow, are accomplished by the improvements hereinafter described and claimed.

In general, an antenna made in accordance with one aspect of the present invention includes a longitudinally extending boom and a plurality of elements carried by the boom at longitudinally spaced locations. Each element has a first portion extending laterally from the boom in one direction, and a second portion extending from the boom in the opposite direction. First and second transmission wires extend along the boom without crossing each other. The first transmission wire alternatingly communicates with the first and second portions of adjacent elements, and the second transmission wire alternatingly communicates with the portions of the elements with which the first transmission wire is not communicating.

In accordance with yet another object of the present invention, the longitudinal boom carries a plurality of elements having differing impedances. The spaced transmission wires communicate with the elements and the diameter of the wires at the point of communication is dependent on the impedance of that element.

In accordance with another aspect of the present invention, the longitudinally extending boom carries a plurality of elements having differing impedances. Spaced transmission wires communicate with the elements, the spacing of the wires at the point of communication with an element being dependent on the impedance of that element.

A preferred exemplary antenna incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
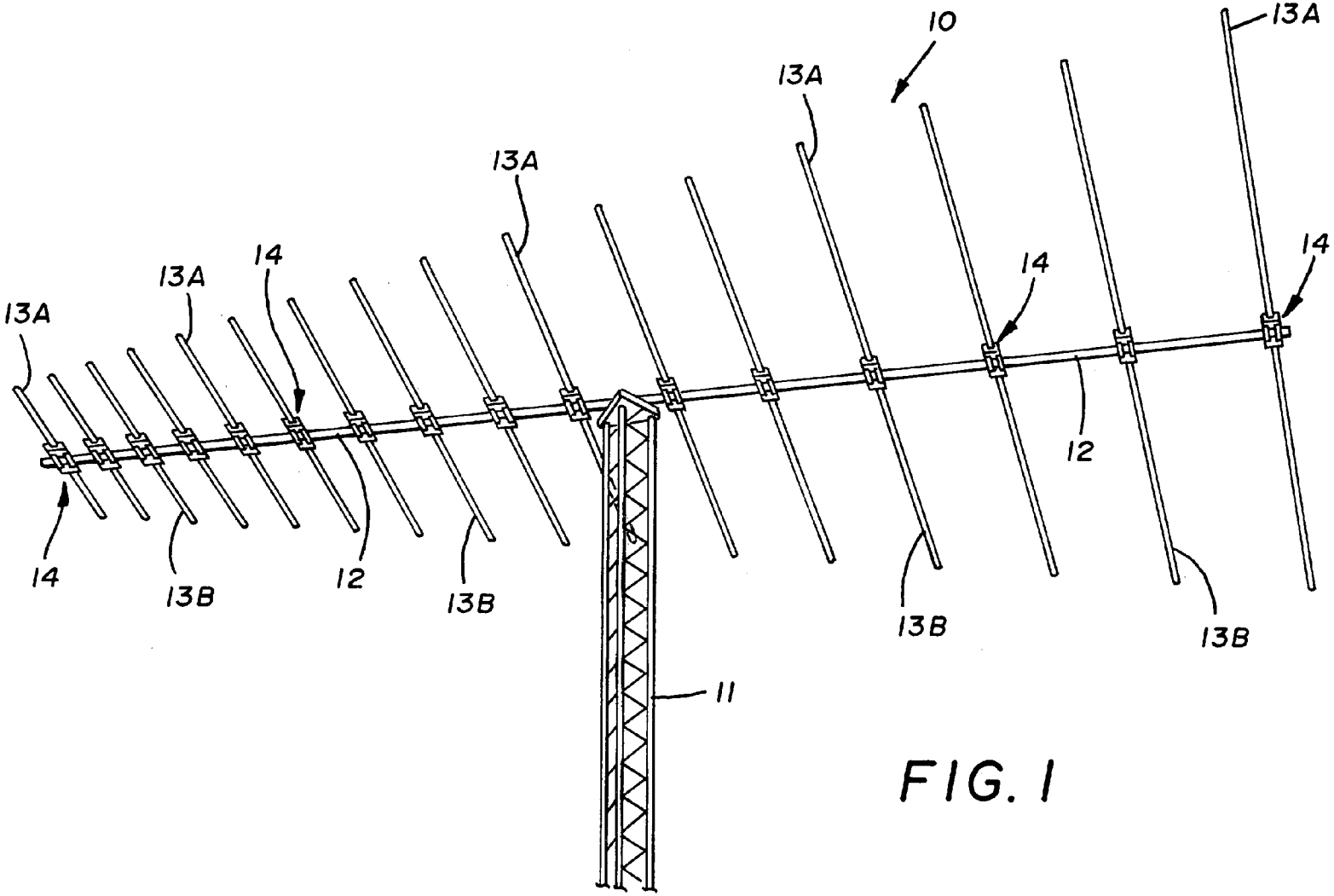
FIG. 1 is a somewhat schematic depiction of the overall configuration of a log-periodic dipole antenna made in accordance with the present invention.

A log-periodic dipole antenna is somewhat schematically shown in FIG. 1 and indicated generally by the numeral 10. Antenna 10 normally includes a tower 11 which carries a horizontally and longitudinally extending boom 12. A plurality of longitudinally spaced elements 13 are made up of half elements 13A and 13B which extend laterally from boom 12 in opposite directions from boom 12. As shown, elements 13 are of varying length and number dependent on the design parameters of antenna 10. Antenna 10 of FIG. 1 is shown as having sixteen elements 13 with elements 13 increasing in length from the left to the right as viewed in FIG. 1.

Figure 2:
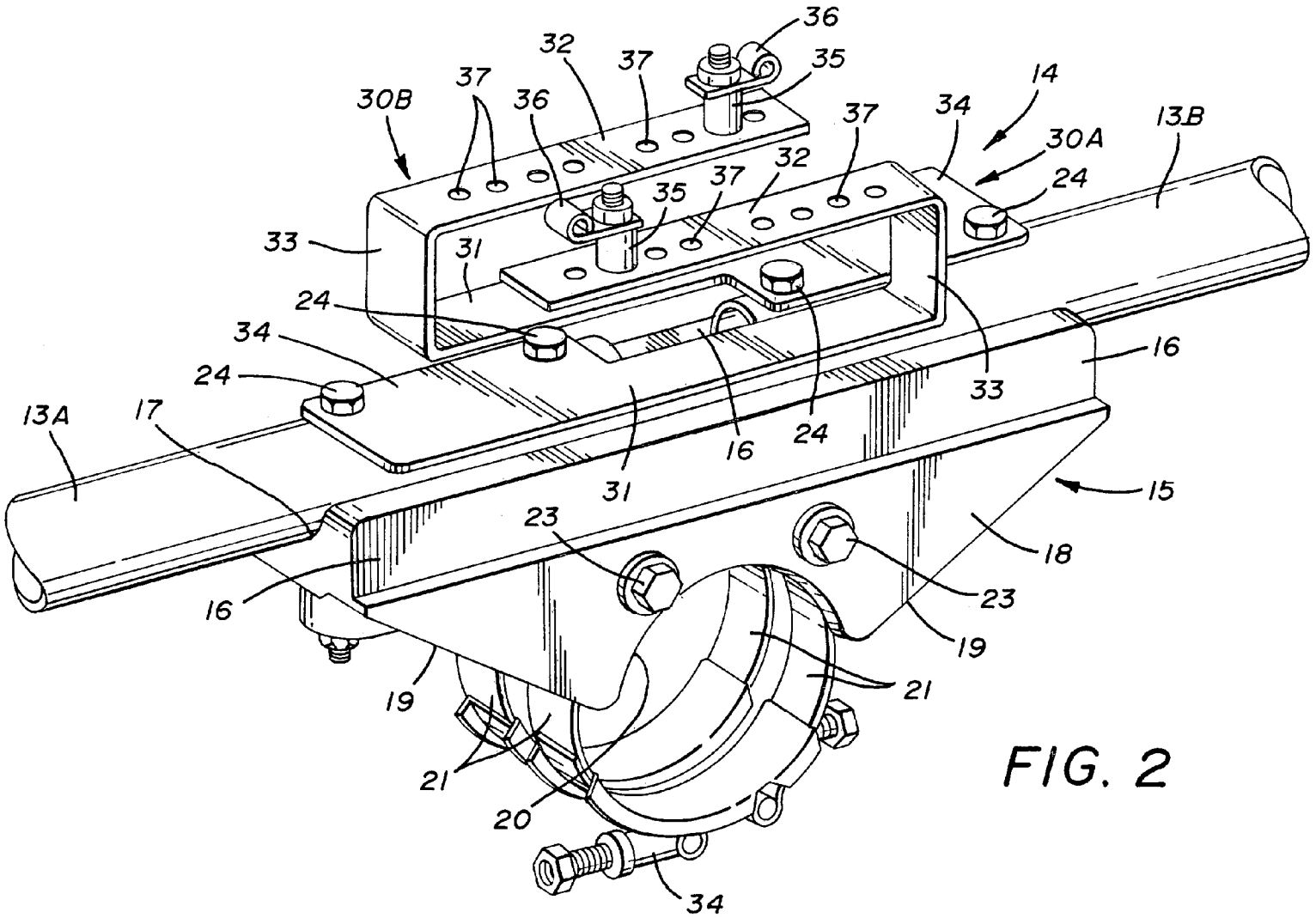
FIG. 2 is a perspective view of an insulator assembly made in accordance with the present invention.

Elements 13 must be isolated from boom 12. As such, an insulator assembly, generally indicated by the numeral 14, is provided at each junction of elements 13 with boom 12. Insulator assembly 14 is best shown in FIG. 2, and its primary component, an insulator block, is generally indicated by the numeral 15. Insulator block 15 is preferably made of a strong, rigid, ultra-violet resistant plastic material, such as rigid thermoplastic polyurethane or the like, and includes opposed shoulders 16 which define at least one element receiving compartment 17 therebetween. Compartment 17 has an arcuate bottom surface designed to generally match the circumference of a range of sizes of elements 13. Opposed sidewalls 18 (one shown) extend downwardly from shoulders 16 and are provided with sloped surfaces 19 which are interconnected by a generally semicircular surface 20.

Insulator assembly 14 also includes two conventional band clamps having a body portion in the form of a band 21, and a clamping portion 22. Bands 21 of the band clamps are adapted to engage boom 12 which extends through the space defined by a portion of bands 21 and semicircular surfaces 20 of block sidewalls 18. To attach insulator block 15 to boom 12, a portion of bands 21 is positioned between sidewalls 18, and bolts 23 received within bands 21 are utilized to hold bands 21 within block 15. Boom 12 is then positioned within bands 21 and received against surfaces 20, and clamping portions 22 are tightened to hold boom 12 in place.

In order to attach element portions or halves 13A and 13B to insulator block 15, the inner ends of element halves 13A and 13B may be provided with two sets of diametrically opposed apertures, and when the ends of halves 13A and 13B are positioned in compartments 17, as shown in FIG. 2, these apertures may receive fasteners 24 therethrough to attach element halves 13A and 13B to block 15.

Each insulator assembly 14 also includes extension brackets, generally indicated by the numeral 30, which are attached to elements 13 by fasteners 24. Specifically, a bracket 30A is attached to element half 13A and a bracket 30B is attached to element half 13B. Brackets 30A and 30B are preferably identical, and each are generally U-shaped. That is, brackets 30A and 30B include opposing legs 31 and 32 joined by connecting leg 33. The opposing legs 31 and 32 are generally parallel and extend perpendicularly from connecting leg 33. A rectangular base portion 34 may be integral with leg 31 and overlies and is attached to an element half via fasteners 24. Leg 31 extends from base portion 34 to a position longitudinally adjacent to, but not contacting, the other element half. Thus, leg 31 of bracket 30A is adjacent to element half 13B, and leg 31 of bracket 30B is adjacent to element half 13A.

Because of the U-shape, leg 32 is disposed above leg 31 and rectangular base portion 34. A feed or transmission wire post 35 is carried by each leg 32. Each wire post 35 incorporates a wire sleeve 36 for connectively engaging the transmission or feeder wires in a manner to be described. As will hereinafter be discussed, in accordance with one aspect of the present invention, posts 35 are positioned at different locations for each insulator assembly 14, and for ease of manufacturing, identical brackets 30 may be manufactured having a plurality of spaced apertures or perforations 37. Posts 35 are thus selectively mountable to perforations 37, dependent on the desired spacing thereof. Alternatively, a plurality of brackets 30 could be manufactured each having an aperture 37 disposed at a designed location—but a location different from the other brackets 30. However, again, for economy, it is preferable to manufacture all brackets 30 alike with the plurality of spaced apertures 37, as shown.

Figure 3:
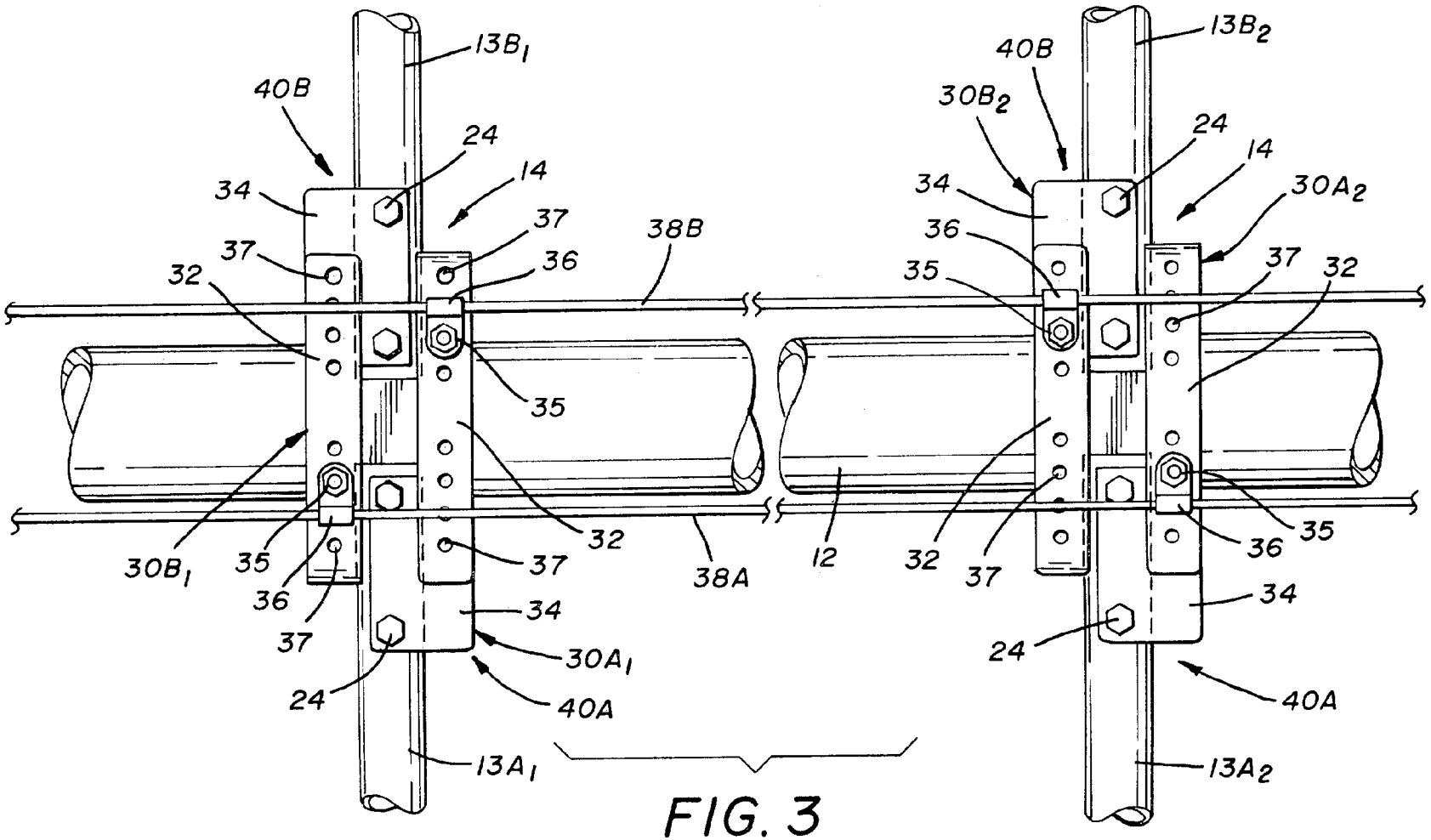
FIG. 3 is a top plan view of two adjacent elements showing the aspects of the present invention wherein the transmission wires are connected to the elements without crossing.
Figure 4:
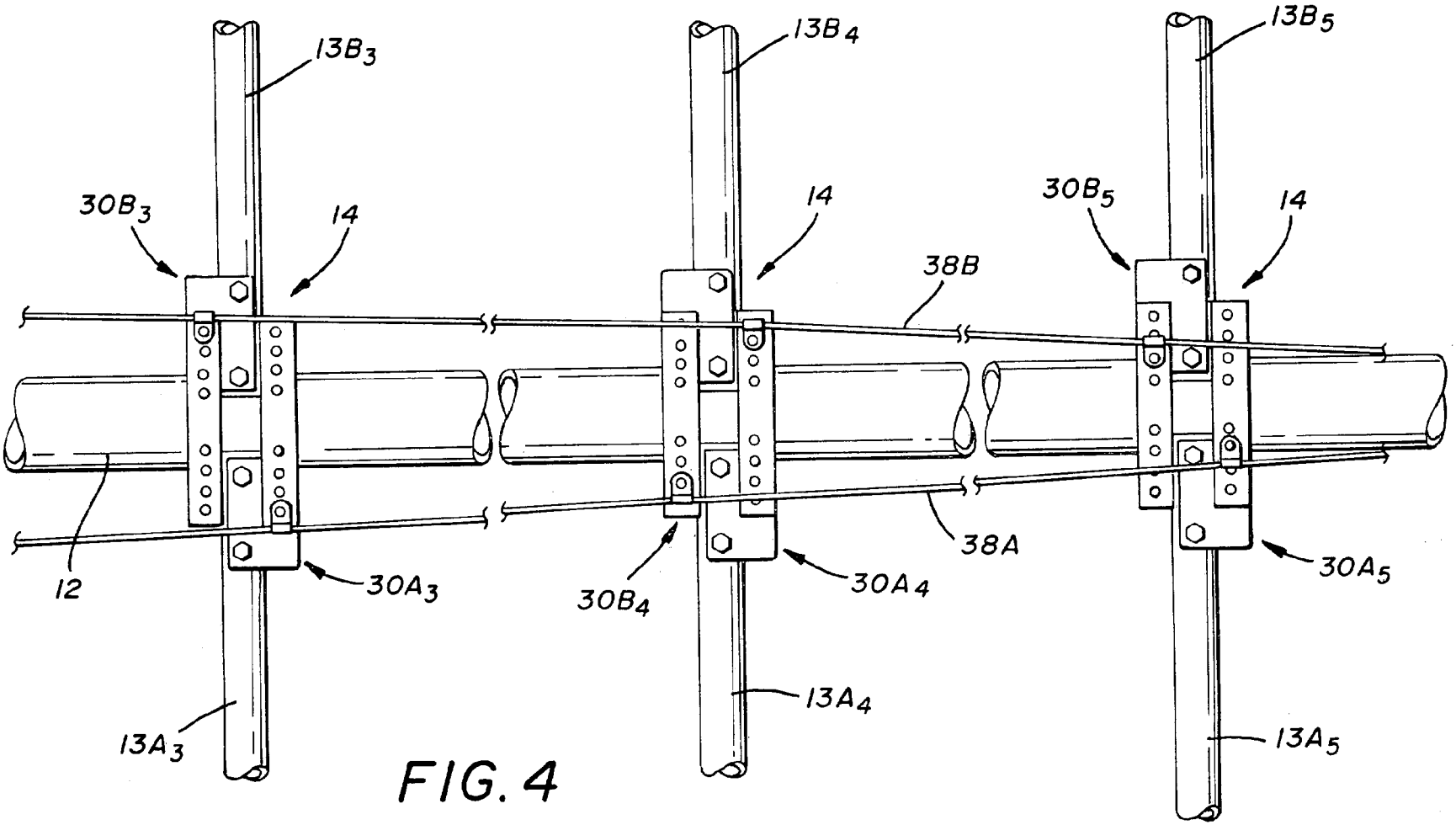
FIG. 4 is a somewhat schematic top plan view of three adjacent elements showing the aspect of the present invention wherein the spacing of the transmission wires may be varied.

As was previously discussed, it is desirable that the transmission or feeder wires, shown in FIGS. 3 and 4 and identified as wires 38A and 38B, should be attached to opposite portions of each successive or adjacent element 13. To that end, in the prior art, it was disadvantageously required that the transmission wires crossed as they extended between elements. However, in accordance with the present invention, as shown in FIGS. 3 and 4, wires 38A and 38B do not cross between adjacent elements 13 and yet are attached to opposite element halves of adjacent elements, as now to be described.

FIG. 3 depicts two adjacent elements on boom 12, one having element portions or halves $\mathbf{13A_1}$ and $\mathbf{13B_1}$, and the other having element portions or halves $\mathbf{13A_2}$ and $\mathbf{13B_2}$. As shown, transmission wire 38A is connected to leg 32 of bracket $\mathbf{30B_1}$ and is therefore attached to element half $\mathbf{13B_1}$. At the adjacent element, transmission wire 38A is attached to leg 32 of bracket $\mathbf{30A_2}$ and is therefore attached to element half $\mathbf{13A_2}$. Similarly, transmission wire 38B, at the left in FIG. 3, is attached to leg 32 of bracket 30A, and is therefore attached to element half $\mathbf{13A_1}$. At the adjacent element, transmission wire 38B is attached to leg 32 of bracket $\mathbf{30B_2}$ and is therefore attached to element half $\mathbf{13B_2}$. The desirable phase reversal is thus accomplished without crossing wires 38A and 38B. Such a reversal configuration continues for each adjacent element 13 with wires 38A and 38B being alternatively connected to element halves 13A and 13B.

It should be also noted that because wires 38A and 38B are carried by posts 35 and wire sleeves 36, they will pass over the top of a bracket 30 that they are not to be attached to. That is, for example, as shown at the left of FIG. 3, wire 38A is carried by a post 35 and wire sleeve 36 on bracket $\mathbf{30B_1}$, and thus wire 38A will pass over leg 32 of bracket $\mathbf{30A_1}$. Likewise, as wire 38A approaches element halves $\mathbf{13A_2}$ and $\mathbf{13B_2}$, it will pass over leg 32 of bracket $\mathbf{30B_2}$ to be attached to post 35 and wire sleeve 36 of bracket $\mathbf{30A_2}$.

In accordance with another aspect of the present invention, because transmission wires 38A and 38B do not cross, it is possible to more easily match the impedance thereof to that of the elements. As previously described, it is desirable to match the impedance of the wires to the impedance of each element at the point that the wires communicate with the elements. The impedance of the elements is proportional to the ratio of their length to diameter, and the impedance of the feeder wires is proportional to their diameter and spacing. In order to utilize insulator assemblies 14 of one size, and for ease of manufacture, it is desirable to provide elements having the same diameter. As such, the longer the element, the greater its impedance that should be matched by the feeder wires. Thus, as shown in FIG. 4, the present invention contemplates varying the spacing of constant diameter wires 38A and 38B dependent on the impedance of the element to which they are connected. For example, in FIG. 4, three adjacent pairs of element halves $\mathbf{13A_3}$, $\mathbf{13B_3}$; $\mathbf{13A_4}$, $\mathbf{13B_4}$; and $\mathbf{13A_5}$, $\mathbf{13B_5}$ are shown spaced along boom 12. For purposes of this discussion, it is assumed that element 13 having element halves $13A_3$, $13B_3$ is the shortest element shown, element 13 having element halves $13A_5$, $13B_5$ is the longest element shown, with element 13 having element halves $13A_4$, $13B_4$ being of a length between the length of the other two elements. As such, in order to match the varying impedances of these elements, wires 38A and 38B are mounted closer together on element halves $13A_5$ and $13B_5$ than they are on element halves $13A_4$ and $13B_4$. Wires 38A and 38B are likewise mounted closer together on elements halves $13A_4$ and $13A_4$ than they are on element halves $13A_3$ and $13B_3$. This is accomplished by positioning posts 35 in different perforations 37 of brackets $30A_3$,$30B_3$; $30A_4$, $30B_4$; and $30A_5$,$30B_5$. Or, as previously described, brackets 30 need not have a plurality of perforations 37, but rather special brackets 30 can be used for each set of element halves. As a result, the distance between wires 38A and 38B at the point that they communicate with or are otherwise connected to elements 13 can be preselected to match the impedance of the element to which they are attached, with the wires being closer together for longer elements and farther apart for shorter elements of the same diameter.

It should also be understood that the impedance of the elements can also be matched by providing feeder wires 38A and 38B with variable diameters spaced a constant distance apart along boom 12. Therefore, rather than varying the spacing of feeder wires 38A and 38B with a constant diameter, the same result can be accomplished with variable diameter wires 38A and 38B spaced a constant distance apart as shown in FIG. 3. As such, the diameter of the feeder wires 38A and 38B will be greatest when mounted to the longest element 13 having element halves $13A_5$ and $13B_5$ and will be smallest when mounted to the shortest element 13 having element halves $13A_3$ and $13B_3$. Furthermore, the diameters of the feeder wires can taper between its greatest diameter and smallest diameter along boom 12. In addition, it is possible to achieve the same result by simultaneously varying the spacing of feeder wires 38A and 38B and the diameter of feeder wires 38A and 38B. As such, it is possible to prevent the wire diameter from getting too thin or the spacing from getting too wide.

It should be noted that the addition of brackets 30 to half elements 13A and 13B provides a structure with a longer electrical length. That is, structures 40A and 40B, consisting of half element 13A and bracket 30A, and half element 13B and bracket 30B, respectively, are electrically lengthened relative to elements 13A and 13B by themselves. However, because of the unique shape of brackets 30, the electrical lengths of structures 40A and 40B remain approximately constant as long as transmission wires 38A and 38B are symmetrically positioned on brackets 30A and 30B about boom 12, that is, positioned equal distances from boom 12 as shown in FIGS. 3 and 4. As a result, when transmission wires 38A and 38B are symmetrically positioned about boom 12 on brackets 30A and 30B, varying the spacing between transmission wires 38A and 38B will have negligible effects on the electrical lengths and the resonant frequency of structures 40A and 40B.

Figure 5:
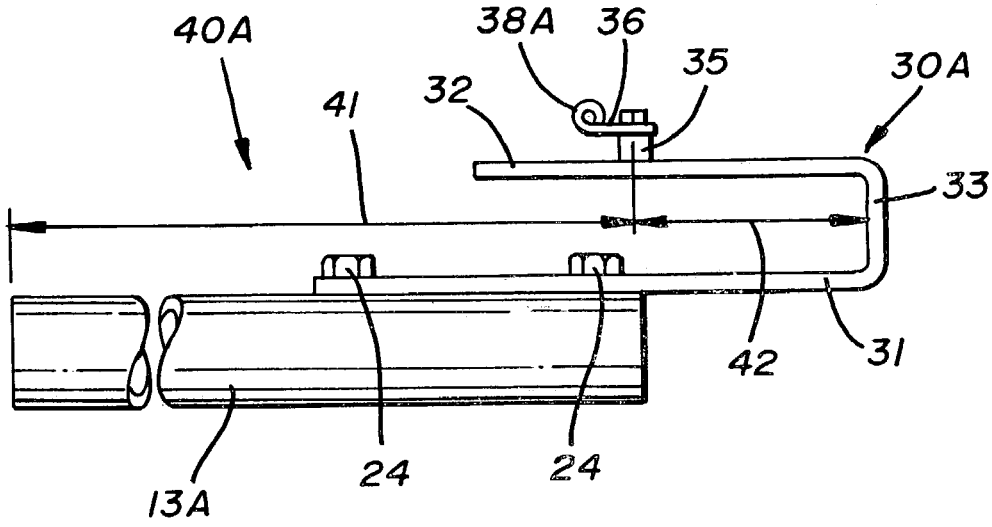
FIG. 5 is a schematic side profile of a bracket attached to a half element showing a transmission wire attached at one position.
Figure 6:
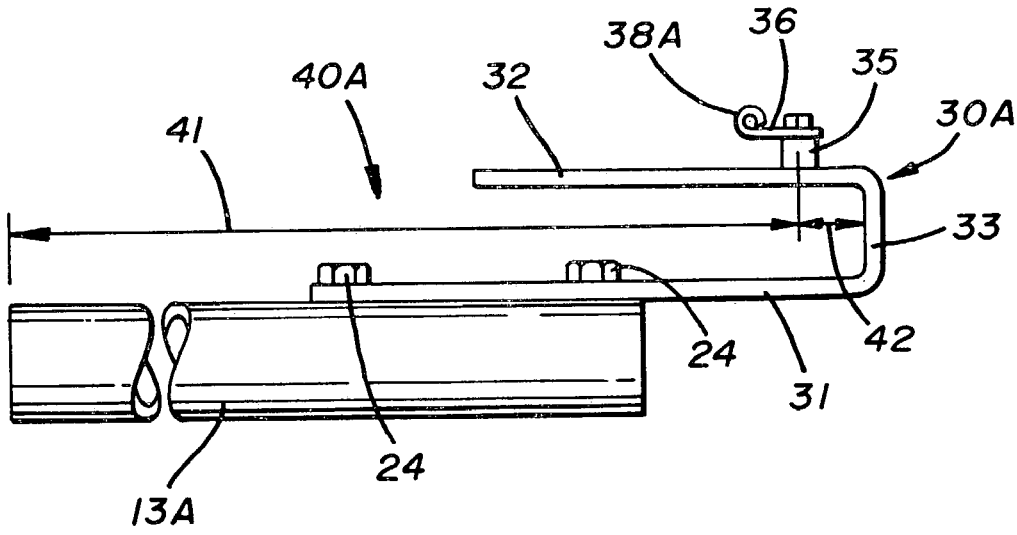
FIG. 6 is a schematic side profile of a bracket attached to a half element similar to FIG. 5 but showing the transmission wire attached at another position.

FIGS. 5 and 6 depict two alternative positions of posts 35 on brackets 30A in order to illustrate that the electrical length of structure 40A is dependent on two physical length components. The first physical length component is the length 41 from the outer end of half element 13A to a point under post 35 to which transmission wire 38A is attached. The second physical length component defines a transmission-line stub and is two times the length 42 from the point under post 35 to connecting leg 33. Length 41 as seen in FIG. 5 is thus shorter than length 41 shown in FIG. 6, and length 42 of FIG. 5 is longer than length 42 in FIG. 6.

Assuming that both configurations of structure 40A have the same overall physical length (measured from the far end of half element 13A to leg 33) in FIGS. 5 and 6, these configurations of structure 40A would also have approximately the same electrical length even though transmission wire 38A is positioned differently. Such a result is possible because structure 40B would mirror structure 40A at insulator assembly 14 in both configurations. Furthermore, irrespective of the position of transmission wire 38A, the electrical length of structure 40A remains the same in both FIGS. 5 and 6 because the inductive reactances dependent on lengths 41 and lengths 42 effectively offset each other in the alternative configurations due to the properties of bracket 30. Therefore, although at each insulator assembly 14 structure 40A will have a different overall physical length, the configurations of structure 40A shown in FIGS. 5 and 6 illustrate that, if transmission wires 38A and 38B are symmetrically positioned about boom 12, then the spacing between transmission wires 38A and 38B can be varied when necessary without effecting the electrical length of structure 40A.

Consequently, for paired structures 40A and 40B of a given physical length at a given insulator assembly 14, the electrical lengths of both structures 40A and 40B are approximately the same as long as transmission lines 38A and 38B are symmetrically positioned along brackets 30A and 30B about boom 12. Therefore, the spacing between transmission wires 38A and 38B will have negligible effects on the electrical length and the resonant frequencies of structures 40A and 40B, and can be varied as required provided that transmission wires 38A and 38B are symmetrically positioned about boom 12.

In view of the foregoing, it should be evident that an antenna constructed in accordance with the present invention as described herein accomplishes the objects of the invention and otherwise substantially improves the art.

What is claimed is:

1. An antenna comprising a longitudinally extending boom, a plurality of elements carried by said boom at longitudinally spaced locations, each of said elements having a first portion extending laterally from said boom in one direction and a second portion extending laterally from said boom in an opposite direction, and first and second spaced transmission wires extending along said boom without crossing each other and being generally equally spaced from said boom, said first transmission wire alternately communicating with said first and second portions of adjacent elements and said second transmission wire alternately communicating with said portions of said elements with which said first transmission wire is not communicating.

2. The antenna of claim 1 further comprising an insulator assembly for each of said elements for connecting said element to said boom.

3. The antenna of claim 2 wherein said insulator assembly includes a block having at least one compartment therein to receive ends of said first portion and said second portion of said element.

4. The antenna of claim 1 wherein said elements have different impedances and the spacing of said wires at a point of communication with an element being dependent on the impedance of that element.

5. The antenna of claim 1 wherein said elements have different impedances and the diameters of said wires at a point of communication with an element being dependent on the impedance of that said element.

6. An antenna comprising a longitudinally extending boom, a plurality of elements carried by said boom at longitudinally spaced locations, each said element having a first portion extending laterally from said boom in one direction and a second portion extending laterally from said boom in the opposite direction, an insulator assembly for each of said elements for connecting said elements to said boom such that said first and second portions are generally axially aligned, said insulator assembly including a first bracket connected to said first portion and a second bracket connected to said second portion, and first and second spaced transmission wires extending along said boom without crossing each other, said first transmission wire alternatingly communicating with said first and second portions of adjacent elements and said second transmission wire alternatingly communicating with said portions of said elements with which said first transmission wire is not communicating.

7. The antenna of claim 6 wherein said first bracket includes a leg at least partially positioned adjacent to said second portion and said second bracket includes a leg at least partially positioned adjacent to said first portion.

8. The antenna of claim 7 wherein each of said brackets includes a second leg spaced from said first leg.

9. The antenna of claim 8 wherein said second legs are provided with a plurality of apertures so that said transmission wires are selectively connected thereto at a predetermined distance from each other, said distance being dependent on an impedance of said element.

10. The antenna of claim 8 wherein at one said insulator assembly said first transmission wire is connected to said second leg of one of said brackets and extends over the other of said brackets, and said second transmission wire extends over said one of said brackets and is connected to said second leg of said other of said brackets.

11. The antenna of claim 10 wherein at an insulator assembly adjacent to said one insulator assembly said first transmission wire is connected to said other of said brackets and extends over said second leg of said one of said brackets, and said second transmission wire extends over said second leg of said other of said brackets and is connected to said one of said brackets.

12. An antenna comprising a longitudinally extending boom, a plurality of elements carried by said boom and having different impedances, and spaced transmission wires communicating with said elements, the spacing of said wires at a point of communication with an element varying dependent on the impedance of that element.

13. The antenna of claim 12 wherein the shorter the element, the further apart said wires are spaced.

14. The antenna of claim 12 wherein diameters of said wires at a point of communication with an element is dependent on the impedance of that element.

15. An antenna comprising a longitudinally extending boom, a plurality of elements carried by said boom and having different impedances, an insulator assembly for each of said elements for connecting said element to said boom, each of said elements having a first portion extending laterally from said assembly in one direction and a second portion extending laterally from said assembly in an opposite direction, and spaced transmission wires communicating with said elements, the spacing of said wires at a point of communication with an element being dependent on the impedance of that element.

16. The antenna of claim 15 wherein one of said transmission wires alternately communicates with said first and second portions of adjacent elements and the other of said transmission wires alternately communicates with said portions of said elements with which said one of said transmission wires is not communicating.

17. The antenna of claim 15, said assembly including a first bracket connected to said first portion and a second bracket connected to said second portion.

18. The antenna of claim 17 wherein said first bracket includes a leg at least partially positioned adjacent to said second portion and said second bracket includes a leg at least partially positioned adjacent to said first portion.

19. The antenna of claim 18 wherein each of said brackets includes a second leg spaced from said first leg.

20. The antenna of claim 19 wherein said second legs are provided with a plurality of apertures so that said wires selectively connected thereto at the spacing dependent on the impedance of the element carried by said assembly.

21. The antenna of claim 20 wherein a portion of said second bracket and an equal portion of said first bracket define an electrical length, and a portion of said first bracket and a portion of said element define a second electrical length, a combination of said electrical lengths being equal no matter where said wire is connected to said second portion.

22. An antenna comprising a longitudinally extending boom, a plurality of elements carried by said boom and having different impedances, and spaced transmission wires communicating with said elements, diameters of said wires at a point of communication with an element being dependent on the impedance of that said element.

23. The antenna of claim 22 wherein the shorter the element, the smaller the diameter of said wires.

24. The antenna of claim 22 wherein the spacing of said wires at a point of communication with an element being dependent on the impedance of that element.

25. An antenna comprising a longitudinally extending boom; a plurality of elements carried by said boom at longitudinally spaced locations and having different impedances, each of said elements having a first portion extending laterally from said boom in one direction and a second portion extending laterally from said boom in the other direction; first and second transmission wires extending along said boom without crossing each other, said first transmission wire alternately communicating with said first and second portions of adjacent elements and said second transmission wire alternately communicating with said portions of said elements with which said first transmission wire is not communicating, the spacing and diameter of said wires at a point of communication with an element being selectively dependent on the impedance of that element.

* * * * *